US011021875B2

(12) United States Patent
Dian

(10) Patent No.: US 11,021,875 B2
(45) Date of Patent: Jun. 1, 2021

(54) REBAR CLAMP ASSEMBLY WITH CLIP

(71) Applicant: Zurn Industries, LLC, Milwaukee, WI (US)

(72) Inventor: Ludovit Dian, Mississauga (CA)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 657 days.

(21) Appl. No.: 15/878,829

(22) Filed: Jan. 24, 2018

(65) Prior Publication Data

US 2018/0209147 A1 Jul. 26, 2018

Related U.S. Application Data

(60) Provisional application No. 62/450,790, filed on Jan. 26, 2017.

(51) Int. Cl.
*E04C 5/16* (2006.01)
*E01C 11/22* (2006.01)

(52) U.S. Cl.
CPC ..... *E04C 5/162* (2013.01); *E04C 5/167* (2013.01); *E01C 11/227* (2013.01)

(58) Field of Classification Search
CPC ..... E04C 5/162; E04C 5/1163; E04C 5/167; F16B 2/04; F16B 2/205; F16B 2/22; F16B 2/24; F16B 2/241; F16B 2/243; F16B 9/023; F16B 2/06; F16B 2/08; F16B 2/14; F16B 2/18; F16B 2/20; Y10T 403/71; Y10T 403/7111; Y10T 403/7147; Y10T 403/7176; Y10T 403/7182; Y10T 403/7188
See application file for complete search history.

(56) References Cited

U.S. PATENT DOCUMENTS 2,231,153 A * 2/1941 Camiener ..... B60R 13/0206 248/73
3,225,545 A 12/1965 Flegel
(Continued)

FOREIGN PATENT DOCUMENTS

CN 1545105 A 11/2004
CN 202797549 U 3/2013
EP 3199431 A1 * 8/2017 ..... B62D 35/008

OTHER PUBLICATIONS

Examination Report issued from the Patent Office of the Cooperation Council for The Arab States of the Gulf for related Application No. GC2018-34659 dated Jun. 2, 2020 (3 Pages).

*Primary Examiner* — Jonathan P Masinick
(74) *Attorney, Agent, or Firm* — Michael Best & Friedrich LLP

(57) ABSTRACT

A rebar clamp assembly for engaging a rebar rod is provided that includes a clip and a rebar clamp. The clip has a pair of prongs spaced apart from one another, connected by a bridging portion. Each prong of the pair of prongs includes an inner surface. The rebar clamp has a pair of sidewalls hingedly connected at a first end of the rebar clamp. Each sidewall includes a rebar-receiving notch on an inner surface and a plurality of clip-receiving notches disposed proximate a second end of the rebar clamp on an outer surface. The plurality of clip-receiving notches of each sidewall are configured to engage one of the inner surfaces of the pair of prongs of the clip to bring the pair of sidewalls of the rebar clamp together around the rebar rod.

16 Claims, 6 Drawing Sheets

(56) References Cited

U.S. PATENT DOCUMENTS

| | | | | |
|---|---|---|---|---|
| 3,252,190 | A * | 5/1966 | Holton | F16L 3/127 403/384 |
| 3,345,706 | A * | 10/1967 | Stokes | F16B 5/0685 403/397 |
| 4,472,078 | A | 9/1984 | Karbstein | |
| 4,699,544 | A | 10/1987 | Karbstein | |
| 5,066,165 | A | 11/1991 | Wofford et al. | |
| 5,281,051 | A | 1/1994 | Stegall | |
| 6,595,720 | B2 | 7/2003 | Humphries et al. | |
| 6,684,594 | B1 | 2/2004 | Sorkin | |
| 7,252,457 | B2 | 8/2007 | Humphries et al. | |
| 7,413,372 | B2 | 8/2008 | Meyers | |
| 8,474,068 | B2 | 7/2013 | Kik, Sr. et al. | |
| 9,702,387 | B2 * | 7/2017 | Harvey | B65D 88/36 |
| 10,156,368 | B2 * | 12/2018 | Rong | F16B 5/0685 |
| 10,253,906 | B2 * | 4/2019 | Vaccaro | F16L 3/133 |
| 2003/0147693 | A1 | 8/2003 | Knak et al. | |
| 2005/0055887 | A1 | 3/2005 | Benesteau et al. | |
| 2011/0162137 | A1 | 7/2011 | Kik, Sr. et al. | |
| 2014/0110007 | A1 | 4/2014 | Humphries et al. | |
| 2016/0319530 | A1 | 11/2016 | Files, Jr. | |
| 2017/0175374 | A1 * | 6/2017 | Funari | E03F 3/046 |

* cited by examiner

REBAR CLAMP ASSEMBLY WITH CLIP

CROSS-REFERENCE TO RELATED APPLICATION

This application claims the benefit of U.S. Provisional Patent Application No. 62/450,790 filed on Jan. 26, 2017, which is incorporated by reference herein in its entirety for all purposes.

STATEMENT OF FEDERALLY SPONSORED RESEARCH OR DEVELOPMENT

Not applicable.

TECHNICAL FIELD

This application relates to a clamp assembly for attachment which may be incorporated in, for example, a modular trench drain to connect the trench drain to rebar rods. More specifically, this application relates to an improved clamp assembly that can be easily clamped onto and unclamped from supporting rebar rods of varying size diameters during installation of the modular trench drain.

BACKGROUND

Trench drains are used where extensive amounts of liquid must be moved from one place to another. The trench drains typically transport the liquid to a drainage sewer. Typically, trench drains are U-shaped or V-shaped troughs and are installed adjacent to either roadways or buildings. They are installed in the ground and secured in concrete.

Trench drain systems include several basic designs: concrete, metal, and plastic. Generally, concrete trench drain systems use forms. The forms are placed in a ditch dug in the ground. Concrete is then poured around the forms, which are removed after the concrete has set. Trench drain systems made in accordance with this method or similar methods result in relatively expensive systems due to the cost of installing and removing the forms.

Many of the expenses associated with these prior art trench drain systems have been overcome by the advent of polymeric trench drains, which can be left in place after the concrete has been poured in place. These trench drains perform two functions. First, they act as a form for the concrete; and second, they act as a liner. The manufacture and transportation costs with this type of trench drain are significantly less than the other types of trench drains.

During installation, the polymeric trench drains are typically affixed to a supporting structure. Generally the supporting structure is formed by a multitude of supporting rebar rods, which are affixed to the polymeric trench drains using various clamps. Typically, installing the polymeric trench drains using the various clamps requires a substantial amount of hardware, i.e., nuts and bolts, which adds not only to the cost, but can also add to the installation time and possibly result in delays should the installer run out of this hardware.

SUMMARY

Various improvements to trench drains are described herein including improvements relating to fixation mechanisms for attachment of the trench drain to rebar or other supports.

According to one aspect, a rebar clamp assembly for engaging a rebar rod is provided that includes a clip and a rebar clamp. The clip has a pair of prongs spaced apart from one another which are connected by a bridging portion. Each prong of the pair of prongs includes an inner surface. The rebar clamp has a pair of sidewalls hingedly connected at a first end of the rebar clamp. Each sidewall includes a rebar-receiving notch on an inner surface and a plurality of clip-receiving notches disposed proximate a second end of the rebar clamp on an outer surface. The plurality of clip-receiving notches of each sidewall are configured to engage one of the inner surfaces of the pair of prongs of the clip to bring the pair of sidewalls of the rebar clamp together around the rebar rod.

In some forms, the clip-receiving notches of each sidewall may include a first clip-receiving notch and a second clip-receiving notch. When the inner surfaces of the pair of prongs engage the clip-receiving notches, the inner surfaces may be selectively engaged with one of the first clip-receiving notches and the second clip-receiving notches to accommodate varying sizes of the rebar rod. Each sidewall may have a first thickness at the first clip-receiving notch and a second thickness at the second clip-receiving notch. The first thickness may be different than the second thickness. The second thickness may be thinner than the first thickness. When the clip engages the second clip-receiving notches, the thinner thickness of the second thickness may allow the rebar clamp assembly to accommodate a rebar rod with a larger diameter than when the clip engages the first clip-receiving notches. The second clip-receiving notch may be disposed more proximate the second end than the first clip-receiving notch. When the clip engages the second clip-receiving notches, the second clip-receiving notches being disposed more proximate the second end may allow the rebar clamp assembly to accommodate a rebar rod with a larger diameter than when the clip engages the first clip-receiving notches.

In some other forms, at least a portion of the inner surfaces of the pair of prongs may be substantially parallel to one another. The inner surfaces of the pair of prongs may include angled portions, which angle away from one another proximate an open end of the clip, opposite the bridging portion, thereby providing extra clearance when the clip is being engaged with the rebar clamp.

In yet some other forms, the rebar clamps may be made of a flexible material. The flexible material may be at least one of a plastic material and a polymeric material. The clip may be made of a rigid material. The rigid material may be at least one of a rigid plastic material, a metallic material, and a ceramic material.

In still yet other forms, the rebar clamp may further have one or more additional rebar-receiving notches on the inner surface of each sidewall (to provide multiple sets of corresponding notches). The rebar-receiving notch and any additional rebar-receiving notches may be configured to receive rebar of a differing or various diameters (for example, 0.5" or 0.375" diameter rebar).

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
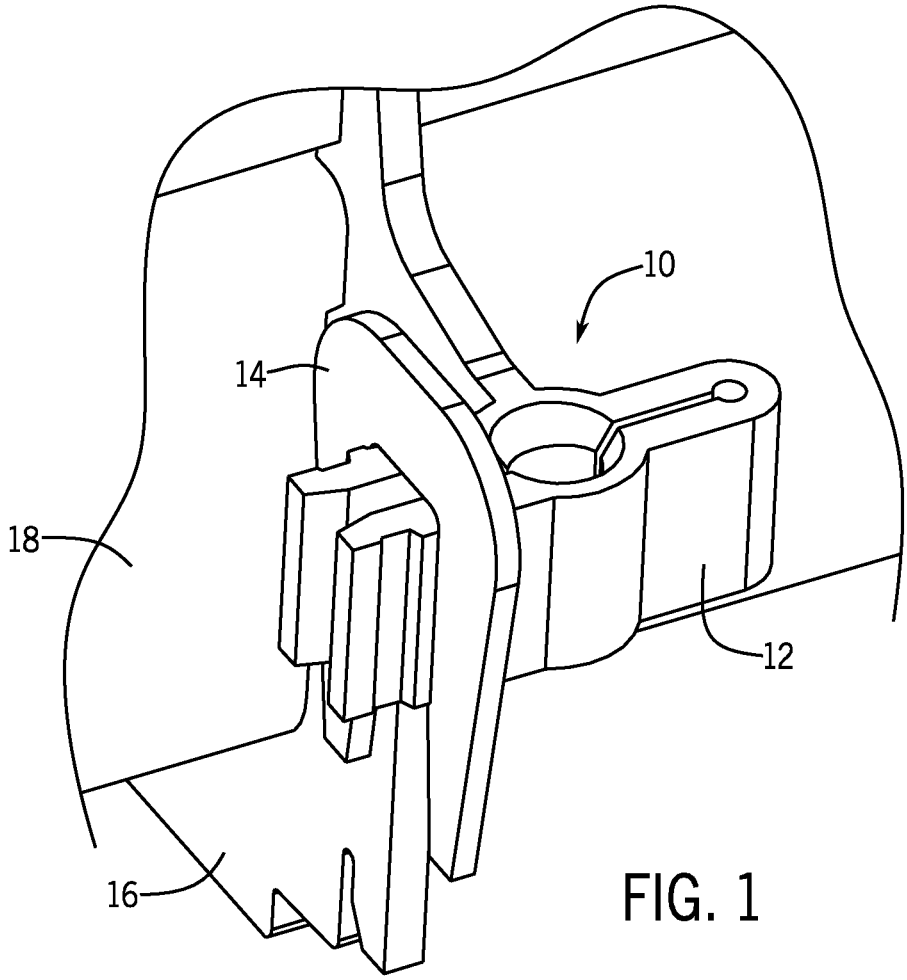
FIG. 1 is a top perspective view of a rebar clamp assembly on a lateral side of a trench drain.

FIG. 1 shows a rebar clamp assembly 10. The rebar clamp assembly 10 includes a rebar clamp 12 and a clip 14 which is designed to engage the rebar clamp 12 to capture a section of rebar therein. In some forms, the rebar clamp assembly 10 can be used to rigidly fix a support rib 16 of a trench drain 18 to a supporting rebar rod during installation of the trench drain 18. However, it is contemplated that, in other forms, the rebar clamp assembly 10 might be used to secure other bodies to which the assembly 10 is adjoined to rebar.

Figure 2:
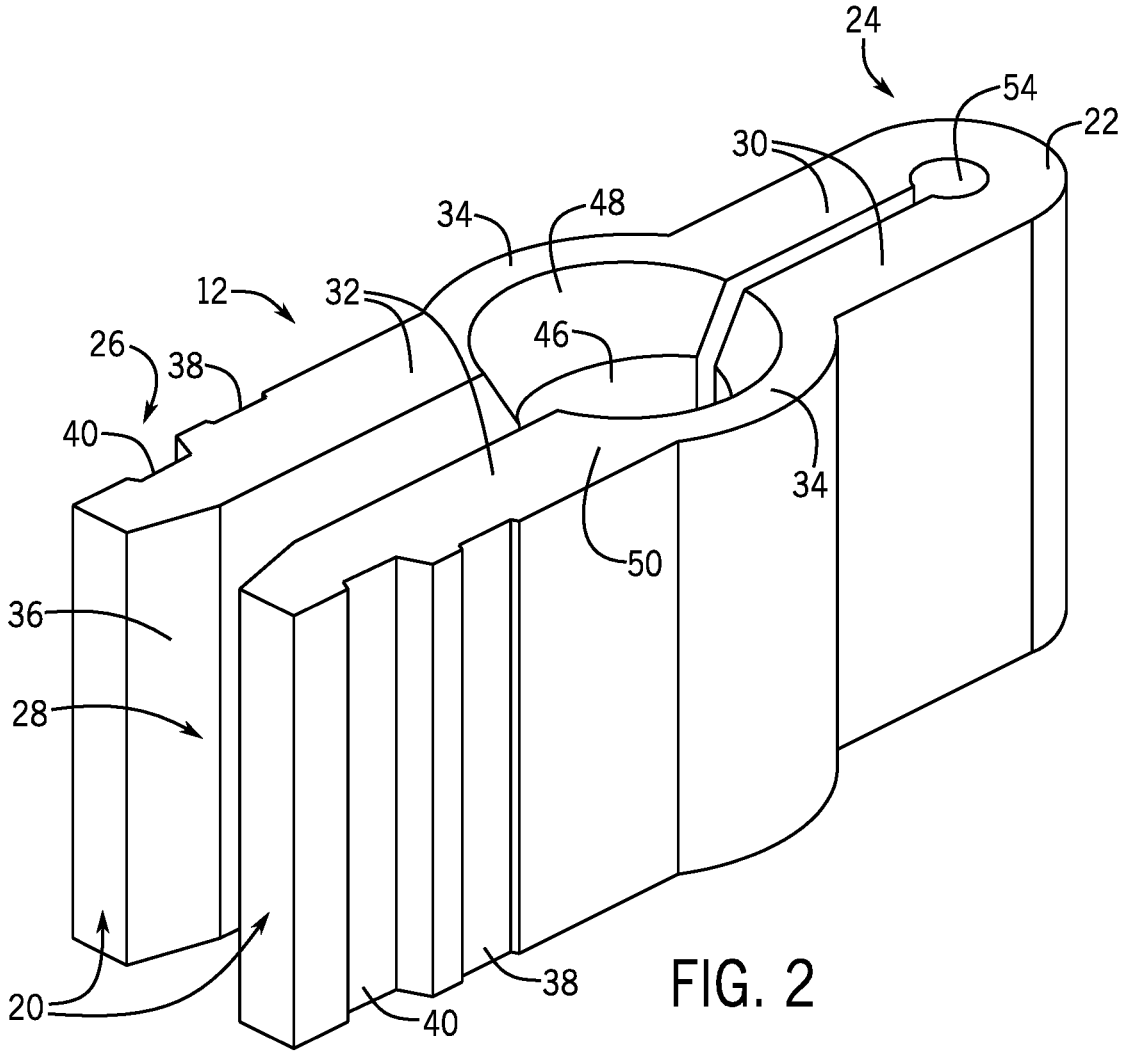
FIG. 2 is a top perspective view of a rebar clamp of the rebar clamp assembly of FIG. 1 apart from the rest of the assembly.
Figure 3:
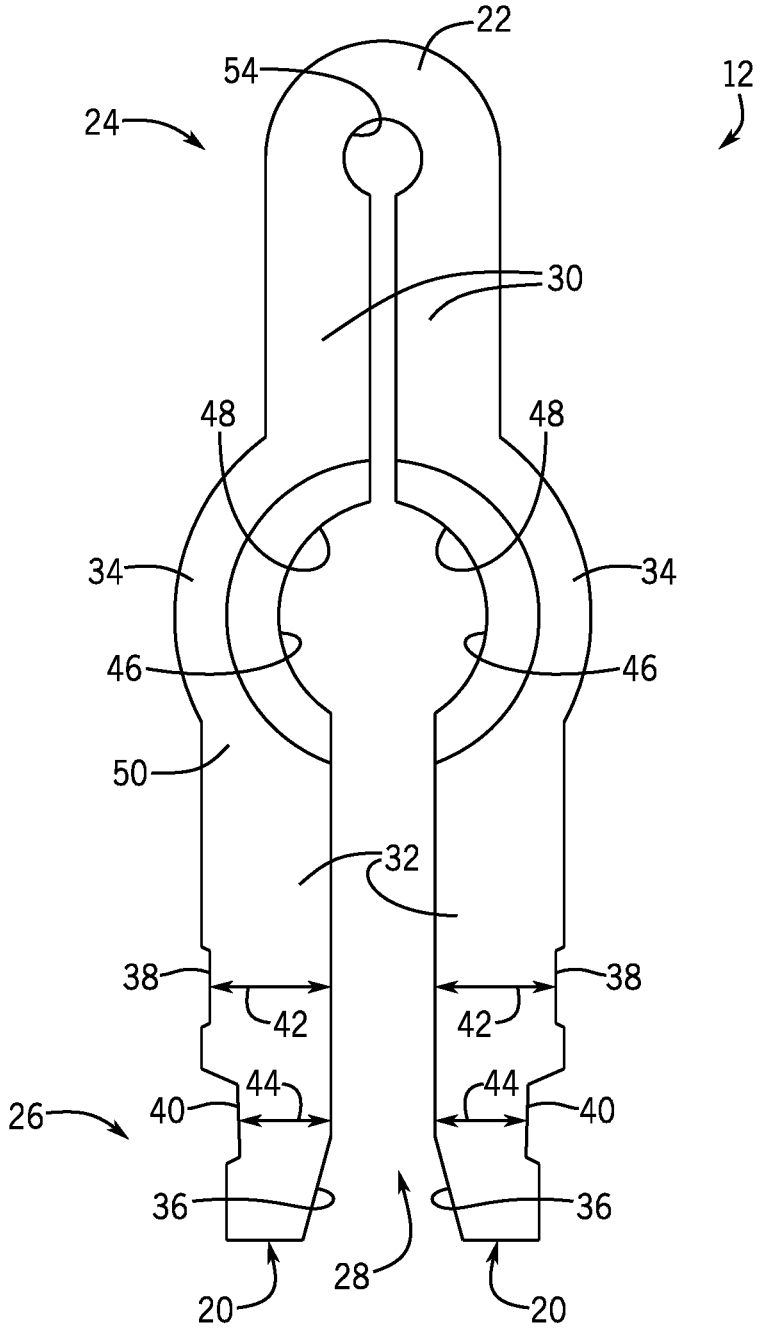
FIG. 3 is a top plan view of the rebar clamp of FIG. 2.

Referring now to FIGS. 2 and 3, the rebar clamp 12 is shown in greater detail and in isolation. The rebar clamp 12 is made of a somewhat elastically flexible material, such as, for example, a plastic material, a polymeric material, or any other suitable material. The rebar clamp 12 includes a pair of sidewalls 20 and a connection portion 22 which, in the form shown, provides a living hinge. The pair of sidewalls 20 are connected by the connection portion 22 at a first end 24 of the rebar clamp 12 and are separated by an opening 28 at a second end 26 of the rebar clamp 12.

Each sidewall 20 includes a first wall portion 30 and a second wall portion 32 with a rebar-receiving portion 34 disposed therebetween. The first wall portion 30 extends between the connection portion 22 and the rebar-receiving portion 34. The second wall portion 32 extends from the rebar-receiving portion 34 toward the second end 26 of the rebar clamp 12 and includes a chamfered edge 36 disposed between the second end 26 and the inner surface of the corresponding sidewall 20.

Additionally, each of the second wall portions 32 further includes a first clip-receiving notch 38 and a second clip-receiving notch 40. Both the first clip-receiving notch 38 and the second clip-receiving notch 40 are disposed on an outer surface of the sidewalls 20. The first clip-receiving notch 38 reduces a wall thickness of the sidewall 20 to a first wall thickness 42. The second clip-receiving notch 40 is disposed more proximate the second end 26 of the rebar clamp 12 than the first clip-receiving notch 38 and reduces the wall thickness of the sidewall 20 to a second wall thickness 44. The first wall thickness 42 is different than the second wall thickness 44.

It is contemplated that, while in the illustrated embodiment the first wall thickness 42 is thicker than the second wall thickness 44, the first wall thickness 42 may alternatively be thinner than or have the same thickness as the second wall thickness 44.

Additionally, it is further contemplated that while the illustrated embodiment includes a first clip-receiving notch 38 and a second clip-receiving notch 40, in other embodiments each sidewall 20 could include any number of additional clip-receiving notches, each reducing the wall thickness of the sidewall to a corresponding wall thickness. Said differently, each sidewall could include a third clip-receiving notch, a fourth clip-receiving notch, and so forth, which would correspondingly reduce the wall thickness to a third wall thickness, a fourth wall thickness, etc., respectively.

The rebar-receiving portion 34 includes a rebar-receiving notch 46 on an inner surface of the corresponding sidewall 20. The rebar-receiving notch 46 of each sidewall 20 is configured to receive rebar rods of varying sizes, as will be described further below. Additionally, the rebar-receiving portion 34 includes countersinks 48 at opposing ends of the rebar-receiving notch 46. A first of the two countersinks 48 is disposed between the rebar-receiving notch 46 and an upper surface 50 of the rebar clamp 12 and a second of the two countersinks 48 is disposed between the rebar-receiving notch 46 and a lower surface (not shown) of the rebar clamp 12. Opposite the rebar-receiving notch 46, the rebar-receiving portion 34 protrudes outwardly to maintain sufficient material thickness within the rebar-receiving portion 34.

The connection portion 22 of the rebar clamp 12 includes a thickness-reducing notch 54. The thickness-reducing notch 54 and the material compliance of the flexible material of the rebar clamp 12 allow for the sidewalls 20 to be slightly rotated relative to one another about the connection portion 22, giving the sidewalls 20 a hinge-like connection. It is contemplated that, while the sidewalls 20 are connected by the connection portion 22 in the present embodiment, in other embodiments, the sidewalls 20 could alternatively be connected by a hinge, or any other suitable hinge-like connection.

Figure 5:
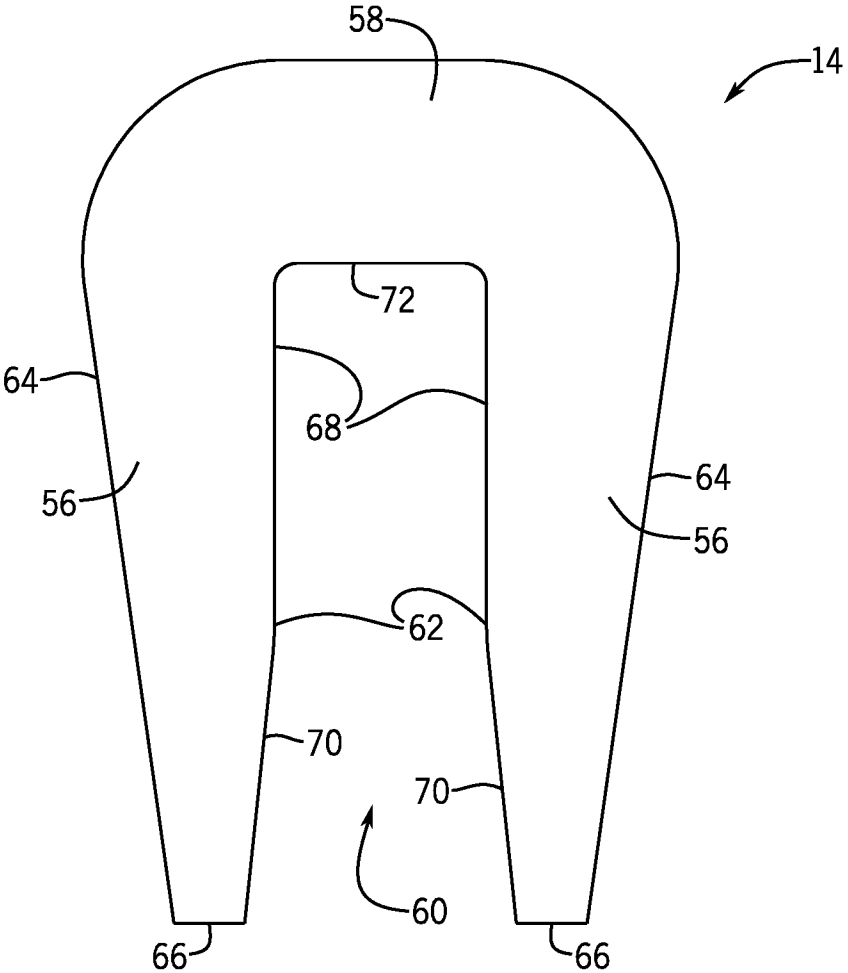
FIG. 5 is a front elevational view of the clip of FIG. 4.
Figure 4:
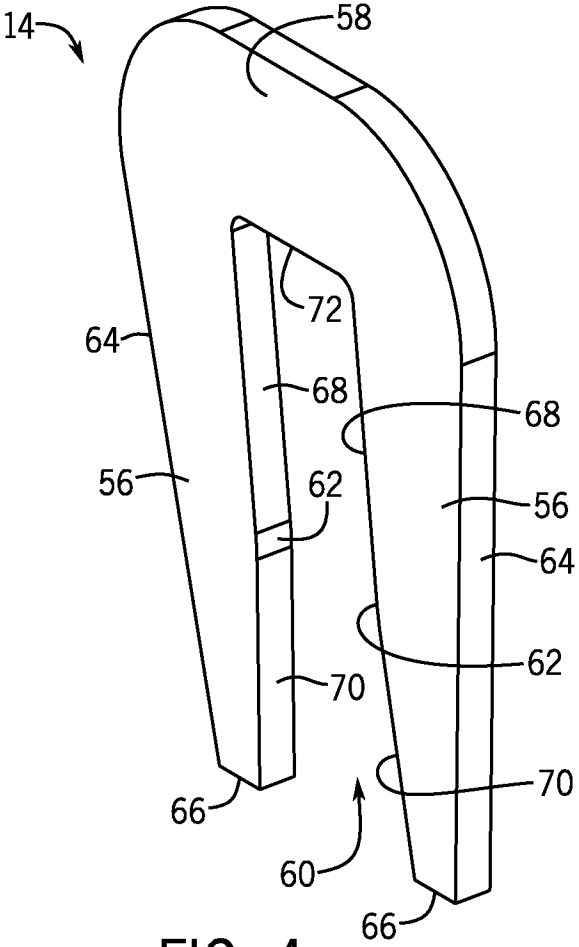
FIG. 4 is a perspective view of a clip of the rebar clamp assembly of FIG. 1 apart from the rest of the assembly.

Referring now to FIGS. 4 and 5, the clip 14 is made of a rigid material, such as, for example, a rigid plastic material, a metallic material, a ceramic material, or any other suitable rigid material. The clip 14 also includes a pair of prongs 56 spaced apart from one another and connected by a bridging portion 58 at a first end of the clip 14 and are separated by an opening 60 at a second end of the clip 14. Additionally, the pair of prongs 56 and the bridging portion 58 have a constant thickness and, as such, conjunctively form a substantially U-shaped feature of even thickness.

Each of the prongs 56 include an inner surface 62, an outer surface 64, and an end surface 66. The inner surface 62 of each prong 56 is disposed on an inner face of the U-shaped feature formed by the pair of prongs 56 and the bridging portion 58. Each inner surface 62 includes a first portion 68 and a second portion 70. Each of the first portions 68 are substantially perpendicular to an inner surface 72 of the bridging portion 58, which is similarly disposed on an inner face of the U-shaped feature. As such, the first portions 68 are substantially parallel to one another. The second portions 70 are disposed adjacent to the end surfaces 66 and are angled with respect to the corresponding first portions 68 (i.e., a plane defined by each first portion 68 is angled from a plane defined by each corresponding second portion 70, such that the planes intersect along a single line and are not coplanar). As illustrated, the second portions 70 of the inner surfaces 62 further angle away from one another proximate the second end of the clip 14, thereby increasing the opening 60.

Now that the structure of the various components of the rebar clamp assembly 10 have been described above, a method of assembly and use will be described below. It will be understood that the following description is meant to be exemplary and is in no way meant to be limiting. The rebar clamp assembly 10 can be assembled or used in accordance with other methods, for other functions, or in other settings generally.

Figure 6:
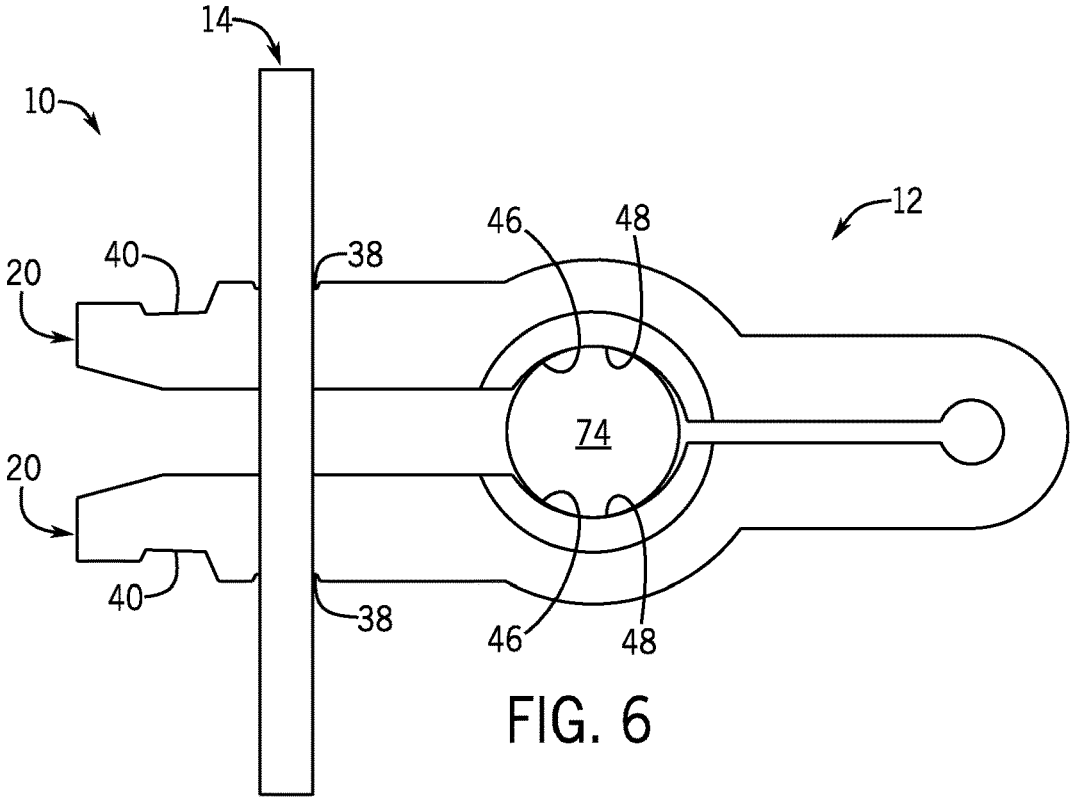
FIG. 6 is a top plan view of the rebar clamp assembly of FIG. 1 shown engaging a rebar rod with the clip engaging first clip-receiving notches of the rebar clamp.

Referring now to FIG. 6, the rebar clamp assembly 10 can be used to grasp or clamp onto a rebar rod 74. To grasp or clamp onto the rebar rod 74, the rebar rod 74 is first inserted between the rebar-receiving notches 46 of the rebar clamp 12, typically without the clip 14 in its final place. The countersinks 48 provide extra clearance between the rebar-receiving notches 46, making inserting the rebar rod 74 easier and guiding the rebar rod 74 through the opening. Once the rebar rod 74 is disposed between the rebar-receiving notches 46 of the rebar clamp 12, the clip 14 can be used to bring the pair of sidewalls 20 of the rebar clamp 12 together around the rebar rod 74. As the sidewalls 20 are brought together around the rebar rod 74, the rebar-receiving notches 46 come into contact with the rebar rod 74, providing a compression-fit grasp or clamp onto the rebar rod 74.

To bring the pair of sidewalls 20 together around the rebar rod 74, the clip 14 is slid onto the rebar clamp 12, with the inner surfaces 62 of the pair of prongs 56 (shown in FIGS. 4 and 5) engaging the first clip-receiving notches 38 of each of the sidewalls 20. As the clip 14 is slid onto the rebar clamp 12, the angling of the second portions 70 of the inner surfaces 62 (shown in FIGS. 4 and 5), which increases the opening 60 of the clip 14 (also shown in FIGS. 4 and 5), provides extra clearance for the inner surfaces 62 to be slid into their respective first clip-receiving notches 38. Further, when the clip 14 is slid onto the rebar clamp 12 and the rebar-receiving notches 46 of the sidewalls 20 compress the rebar rod 74, the sidewalls 20 flex slightly around the rebar rod 74. Being made of the flexible material, the sidewalls 20 tend to resist this flexing, resulting in a force imparted upon the inner surfaces 62 of the clip 14. The parallel configuration of the first portions 68 of the inner surfaces 62 prevents the clip 14 from sliding off of the rebar clamp 12.

The rebar clamp assembly 10 can also release the rebar rod 74 by sliding the clip 14 off of the rebar clamp 12. Once the clip 14 is slid off of the rebar clamp 12, the sidewalls 20 no longer compressively grasp or clamp onto the rebar rod 74, and the rebar rod 74 can be removed from between the rebar-receiving notches 46.

Figure 7:
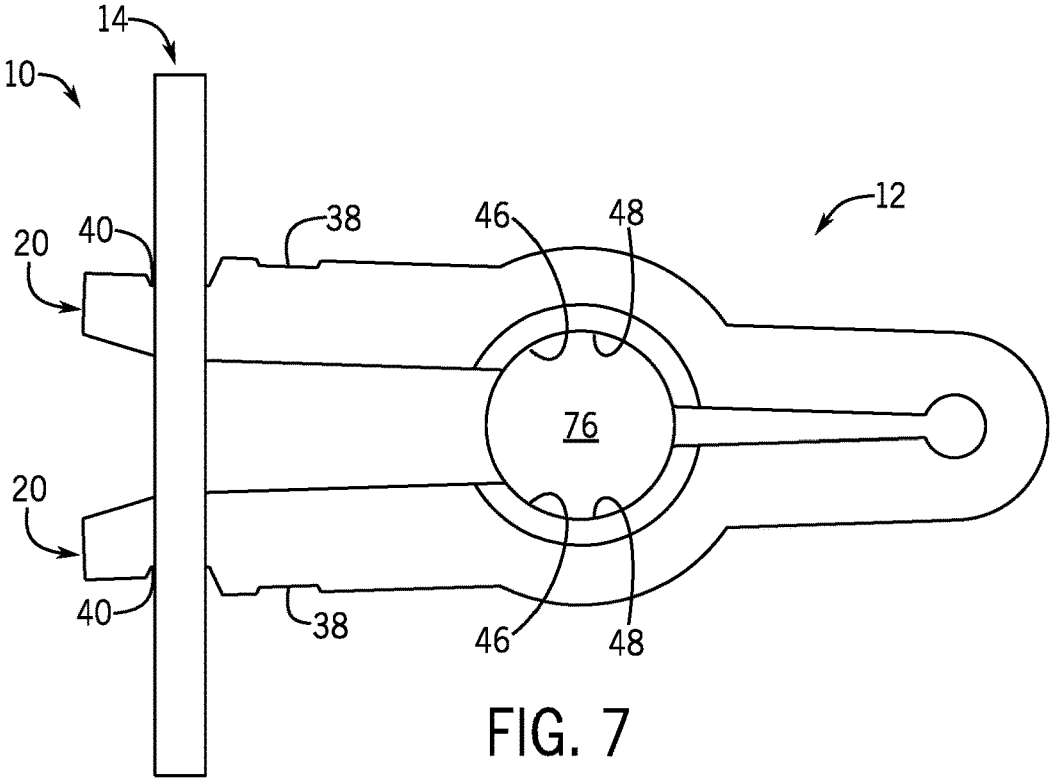
FIG. 7 is a top plan view of the rebar clamp assembly of FIG. 1 shown engaging a rebar rod with the clip engaging second clip-receiving notches of the rebar clamp.

Referring now to FIG. 7, the rebar clamp assembly 10 can similarly be used to grasp or clamp onto a rebar rod 76 having a diameter that is larger than the rebar rod 74. Similarly, to grasp or clamp onto the rebar rod 76, the rebar rod 76 can first be inserted between the rebar-receiving notches 46 of the rebar clamp 12. Once the rebar rod 76 is disposed between the rebar-receiving notches 46 of the rebar clamp 12, the clip 14 can again be used to bring the pair of sidewalls 20 of the rebar clamp 12 together around the rebar rod 74.

To accommodate the larger diameter of the rebar rod 76, to bring the pair of sidewalls 20 together around the rebar rod 76, the clip 14 can be slid onto the rebar clamp 12 with the inner surfaces 62 of the pair of prongs 56 (shown in FIGS. 4 and 5) alternatively engaging the second clip-receiving notches 40. Due to the second wall thickness 44 being thinner than the first wall thickness 42 (shown in FIGS. 4 and 5), and the second clip-receiving notch 40 being disposed more proximate the second end 26 of the rebar clamp 12 than the first clip-receiving notch 38 (also shown in FIGS. 4 and 5), the sidewalls 20 are permitted to open farther (i.e., to a greater angular extent relative to that depicted in FIG. 6) while the clip 14 engages the second clip-receiving notches 40. The sidewalls 20 opening farther allows for the rebar clamp 12 to receive the rebar rod 76 with the larger diameter, while still being able to compressively grasp or clamp onto the rebar rod 76.

The rebar clamp assembly 10 can then similarly release the rebar rod 76 as described above with reference to the rebar rod 74.

Referring now to FIGS. 1, 6, and 7 generally, the rebar clamp assembly 10 can be affixed to various objects, such as the illustrated support rib 16 of the trench drain 18 shown in FIG. 1. The rebar clamp assembly 10 can then be used to grasp or clamp onto varying sizes of rebar rods, such as the illustrated rebar rods 74, 76 shown in FIGS. 6 and 7. As such, the rebar clamp assembly 10 can be used to rigidly fix the trench drain 18 to various rebar rods 74, 76. This may be useful, for example, during installation of the trench drain 18, to provide support to the trench drain 18 while concrete is poured around the trench drain 18 and allowed to set.

Figure 8:
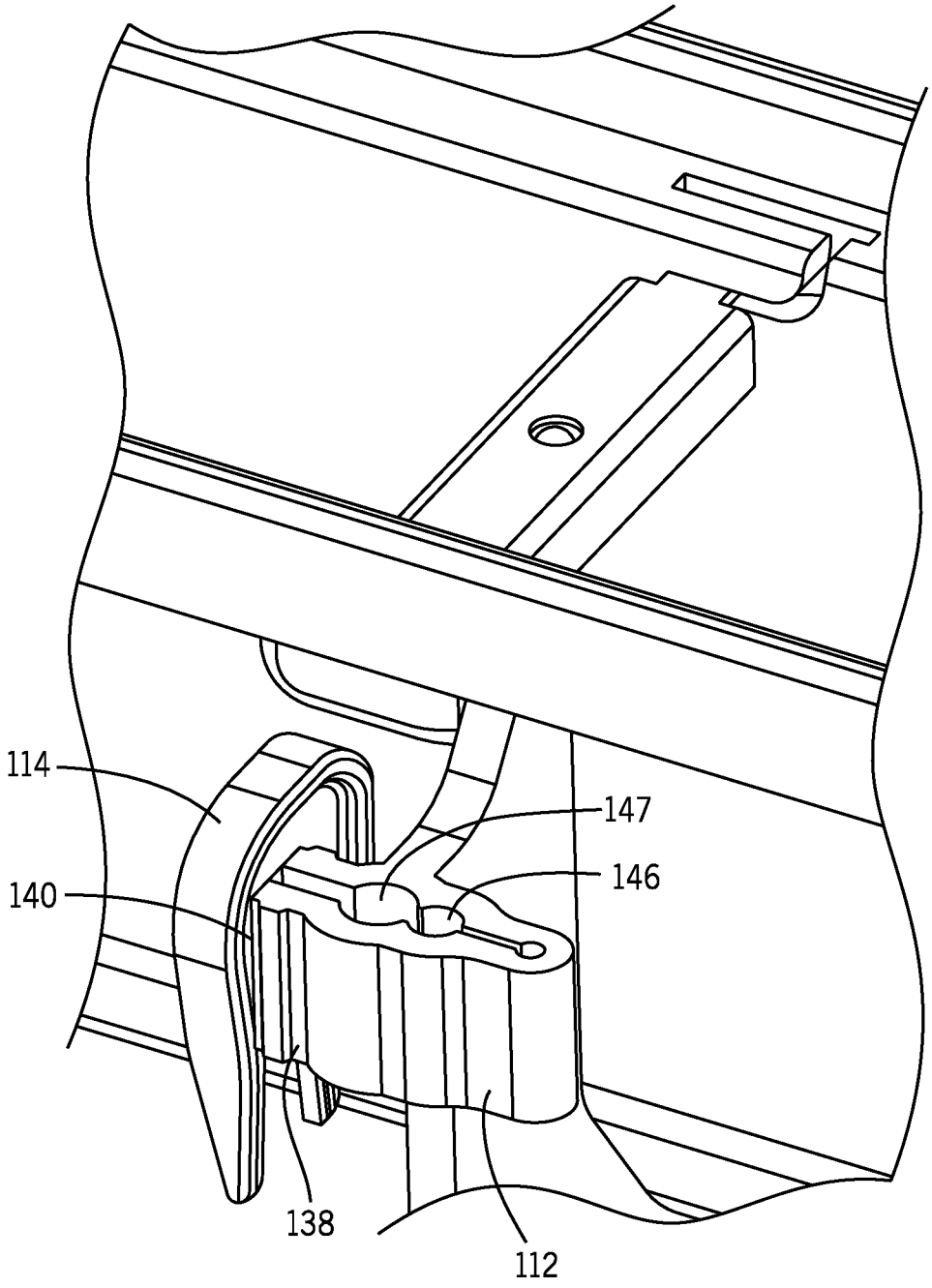
FIG. 8 is a perspective view of another, modified rebar clamp design with an additional set of rebar-receiving notches.

Referring to FIG. 8, an alternative embodiment of a rebar clamp 112 is shown. The rebar clamp 112 differs from the rebar clamp 12 in FIGS. 1 through 7, in that instead of a single set of rebar-receiving notches, there are multiple sets of rebar-receiving notches to better or further accommodate different or variously-sized diameters of rebar. In FIG. 8, similar reference numerals are used to refer to similar features from FIGS. 1 through 7, except that a "100" series number is provided in FIG. 8 to distinguish the different embodiment.

As illustrated in FIG. 8, the rebar clamp 112 has a set of additional rebar-receiving notches 147 (one on each sidewall) which set is configured to receive a different sized rebar (that is, of different diameter) than the other set of rebar receiving notches 146. As with the first embodiment, there are a first set of clip-receiving notches 138 and a second set of clip-receiving notches 140 which may be selectively engaged by a clip 114. As noted above, this can permit or accommodate differential closing amounts of the rebar-receiving notches, here both of the sets of notches 146 and 147 (instead of just a single set of notches 46 as in FIGS. 1 through 7). By virtue of this structure having both dual rebar-receiving notches and dual clip-receiving notches, both of the set of the rebar-receiving notches can clamped to two levels (by the clip 114 engaging either the first set of clip-receiving notches 138 or the second set of clip-receiving notches 140), thereby providing four possible clamping diameters by the various configurational permutations.

While a first arrangement has been shown with one set of rebar-receiving notches and two sets of clip-receiving notches and a second arrangement has been shown with two sets of rebar-receiving notches and two sets of clip-receiving notches, it will be appreciated that other configurations for a rebar clap are contemplated with the rebar clamp having multiples of one or both of the rebar-receiving notches and the clip-receiving notches. For example, there may be multiple sets of rebar-receiving notches and only one set of clip-receiving notches. As another example, there may be multiple sets of clip-receiving notches and only one set of rebar-receiving notches. Still further, there could be multiple sets of clip-receiving notches and multiple sets of rebar-receiving notches. While sets of two and two are shown in FIG. 8, there could be more than two of one or each type of notch.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A rebar clamp assembly for engaging a rebar rod, the rebar clamp assembly comprising:

a clip having a pair of prongs spaced apart from one another and connected by a bridging portion, each prong of the pair of prongs including an inner surface; and a rebar clamp having a pair of sidewalls hingedly connected at a first end of the rebar clamp, each sidewall including a rebar-receiving notch on an inner surface and a plurality of clip-receiving notches disposed proximate a second end of the rebar clamp on an outer surface, the plurality of clip-receiving notches of each sidewall being configured to engage one of the inner surfaces of the pair of prongs of the clip to bring the pair of sidewalls of the rebar clamp together to produce a compression-fit grasp onto the rebar rod.

2. The rebar clamp assembly of claim 1, wherein the clip-receiving notches of each sidewall include a first clip-receiving notch and a second clip-receiving notch.

3. The rebar clamp assembly of claim 2, wherein when the inner surfaces of the pair of prongs engage the clip-receiving notches, the inner surfaces are selectively engaged with one of the first clip-receiving notches and the second clip-receiving notches to accommodate varying sizes of the rebar rod.

4. The rebar clamp assembly of claim 2, wherein each sidewall has a first thickness at the first clip-receiving notch and a second thickness at the second clip-receiving notch, the first thickness being different than the second thickness.

5. The rebar clamp assembly of claim 4, wherein the second thickness is thinner than the first thickness.

6. The rebar clamp assembly of claim 5, wherein when the clip engages the second clip-receiving notches, the thinner thickness of the second thickness allows the rebar clamp assembly to accommodate a rebar rod with a larger diameter than when the clip engages the first clip-receiving notches.

7. The rebar clamp assembly of claim 2, wherein the second clip-receiving notch is disposed more proximate the second end than the first clip-receiving notch.

8. The rebar clamp assembly of claim 7, wherein when the clip engages the second clip-receiving notches, the second clip-receiving notches being disposed more proximate the second end allows the rebar clamp assembly to accommodate a rebar rod with a larger diameter than when the clip engages the first clip-receiving notches.

9. The rebar clamp assembly of claim 1, wherein at least a portion of the inner surfaces of the pair of prongs are substantially parallel to one another.

10. The rebar clamp assembly of claim 9, wherein the inner surfaces of the pair of prongs include angled portions, which angle away from one another proximate an open end of the clip, opposite the bridging portion, thereby providing extra clearance when the clip is being engaged with the rebar clamp.

11. The rebar clamp assembly of claim 1, wherein the rebar clamp is made of a flexible material.

12. The rebar clamp assembly of claim 11, wherein the flexible material is at least one of a plastic material and a polymeric material.

13. The rebar clamp assembly of claim 1, wherein the clip is made of a rigid material.

14. The rebar clamp assembly of claim 13, wherein the rigid material is at least one of a rigid plastic material, a metallic material, and a ceramic material.

15. The rebar clamp assembly of claim 1, wherein the rebar clamp further comprises at least one additional rebar-receiving notch on the inner surface of each sidewall.

16. The rebar clamp assembly of claim 15, wherein the rebar-receiving notch and the at least one additional rebar-receiving notch are configured to receive rebar of a different diameter.

* * * * *